US011196204B2

(12) United States Patent
Schwarz et al.

(10) Patent No.: US 11,196,204 B2
(45) Date of Patent: Dec. 7, 2021

(54) SPRING-LOADED INNER-CONDUCTOR CONTACT ELEMENT

(71) Applicant: Rosenberger Hochfrequenztechnik GmbH & Co. KG, Fridolfing (DE)

(72) Inventors: Benedikt Schwarz, Garching (DE); Andreas Gruber, Ainring (DE); Johannes Heubeck, Fridolfing (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 122 days.

(21) Appl. No.: 16/650,422

(22) PCT Filed: Jun. 27, 2018

(86) PCT No.: PCT/EP2018/067282
§ 371 (c)(1),
(2) Date: Mar. 25, 2020

(87) PCT Pub. No.: WO2019/063149
PCT Pub. Date: Apr. 4, 2019

(65) Prior Publication Data

US 2021/0167541 A1 Jun. 3, 2021

(30) Foreign Application Priority Data

Sep. 28, 2017 (DE) ..... 102017009065.3

(51) Int. Cl.
*H01R 13/41* (2006.01)
*H01R 12/71* (2011.01)
*H01R 13/15* (2006.01)

(52) U.S. Cl.
CPC ..... *H01R 13/41* (2013.01); *H01R 12/714* (2013.01); *H01R 13/15* (2013.01)

(58) Field of Classification Search
CPC ..... H01R 13/41; H01R 13/15; H01R 12/714
See application file for complete search history.

(56) References Cited

U.S. PATENT DOCUMENTS 5,427,535 A * 6/1995 Sinclair ..... H01R 13/2414 439/66
6,079,987 A * 6/2000 Matsunaga ..... G01R 1/0416 439/66
7,458,818 B2 * 12/2008 Kiyofuji ..... G01R 1/07371 324/750.07
7,467,952 B2 * 12/2008 Hsiao ..... H01R 13/2421 439/66

(Continued)

FOREIGN PATENT DOCUMENTS

CN 100414778 C * 8/2008 ..... H01R 24/50
DE 2421321 A1 11/1975

(Continued)

*Primary Examiner* — Abdullah A Riyami
*Assistant Examiner* — Nader J Alhawamdeh
(74) *Attorney, Agent, or Firm* — David P. Dickerson

(57) ABSTRACT

The invention relates to a spring-loaded inner-conductor contact element comprising at least one inner conductor and an elastic element that surrounds the at least one inner conductor. The axial dimension of the at least one inner conductor can be modified. The at least one inner conductor is metallic. The elastic element is made of an electrically insulating material and is attached to each inner conductor.

20 Claims, 5 Drawing Sheets

(56) References Cited

U.S. PATENT DOCUMENTS

| | | | | |
|---|---|---|---|---|
| 9,640,883 | B2 * | 5/2017 | Tatzel | H01R 12/91 |
| 9,793,635 | B2 * | 10/2017 | Lee | G01R 1/02 |
| 2004/0029433 | A1 | 2/2004 | Lee | |
| 2013/0337666 | A1 * | 12/2013 | Walczyk | H01R 12/712<br>439/66 |
| 2014/0357099 | A1 * | 12/2014 | Tatzel | H01R 12/91<br>439/65 |

FOREIGN PATENT DOCUMENTS

| | | | |
|---|---|---|---|
| DE | 20316337 | U1 | 1/2004 |
| DE | 102005033915 | A1 | 2/2007 |
| EP | 2680371 | A1 | 1/2014 |
| EP | 2680372 | A1 | 1/2014 |
| JP | 2004047268 | A | 2/2004 |
| WO | 0122537 | A1 | 3/2001 |
| WO | 2010084405 | A1 | 7/2010 |

* cited by examiner

C C:

D D:

SPRING-LOADED INNER-CONDUCTOR CONTACT ELEMENT

FIELD OF THE INVENTION

The present disclosure relates to a spring-loaded inner-conductor contact element, an elastic element, which is contained in this spring-loaded inner-conductor contact element, and an assembly, which contains this spring-loaded inner-conductor contact element.

TECHNICAL BACKGROUND

So-called board-to-board plug connectors have established themselves as quick data transmission interface for high-frequency signals between two high-frequency components, for example two printed circuit boards, each comprising a high-frequency electronics. These board-to-board plug connectors have the task of realizing an electrical connection for high-frequency signals between the two high-frequency components with adapted characteristic wave impedance.

In a particular form, the outer-conductor contacts on the two high-frequency components are firmly connected to one another via an electroconductive intermediate component, which serves as outer conductor. This electroconductive component can be, for example, an electroconductive sleeve or an electroconductive board comprising a bore. For a high-frequency transmission, an inner conductor is arranged coaxially in the bore of the sleeve or of the board between the two high-frequency components.

While the intermediate component, which serves as outer conductor, is embodied to be rigid and is typically firmly connected to the two high-frequency components via a screw connection, soldering or welding, the inner conductor has to compensate an axial offset between the two high-frequency components due to a production-related inaccuracy in the planarity between the two high-frequency components.

To compensate the axial offset between the two high-frequency components, the inner conductor is in each case realized as so-called SLC contact element (spring loaded contact). The setup and the mode of operation of an SLC contact element of this type follows for example from DE 20316337 U1.

An SLC contact element thereby has a contact pin, which is resiliently mounted in a bushing-shaped housing. While the bushing-shaped housing is typically fixed to the one high-frequency component, the contact pin contacts the respective other high-frequency component with its contact tip. Due to the resilience of the contact pin in the bushing-shaped housing, a sufficient contact pressure and thus a safe electrical contact between the contact tip of the contact pin and an associated contact surface can be realized on the respective other high-frequency component within a certain area for the distance between the two high-frequency components.

The realization of a board-to-board plug connector based on SLC technology for the transmission of high-frequency signals disadvantageously still requires too many individual parts, which increases the costs for the assembly and the logistics unnecessarily. In addition, board-to-board plug connectors of this type disadvantageously also have a geometric expansion, which is too large to be able to fulfill future requirements with regard to the distance between several high-frequency contact elements in SLC technology, which are each positioned in a grid or in a row.

This is a state, which needs to be improved.

SUMMARY OF THE INVENTION

In view of the above, the present aims to provide an inner-conductor contacting for a high-frequency transmission between two high-frequency components and given fixed outer-conductor contacting between the two high-frequency components, and an insulation between outer-conductor and inner-conductor contacting, which is minimized with regard to the size and the number of its individual parts.

In view of the aforementioned aim, the present disclosure teaches a spring-loaded inner-conductor contact element comprising

- at least one inner conductor and
- an elastic element surrounding the at least one inner conductor,
- wherein the axial extension of the at least one inner conductor is variable,
- wherein the at least one inner conductor is metallic in each case,
- wherein the elastic element is made of an electrically insulating material, and
- is fixed to each inner conductor.

The present disclosure furthermore teaches an elastic element

- of an electrically insulating material,
- which is set up in such a way that it can be fixed to each inner conductor of a spring-loaded inner-conductor contact element.

An underlying concept of the present disclosure is to implement the two technical functions, which are in each case originally realized in two separate components, of the electrical insulating (insulator element) and of the application of an axial elasticity (spring), in a single component. In accordance with the present disclosure, a spring-loaded inner-conductor contact element comprising at least one metallic inner conductor may be supplemented for this purpose with an elastic element of an electrically insulating material, which surrounds the at least one inner conductor. If the spring-loaded inner-conductor contact element is inserted between the two components of an assembly, which are preferably high-frequency components of a high-frequency assembly, and within at least one outer-conductor contact element, the elastic element of electrically insulating material serves as insulator element within a high-frequency transmission path between the two high-frequency components. Due to its elasticity and its fixation to the at least one inner conductor, the elastic element, in the compressed case—when the at least one inner conductor, which is in each case variable in its axial extension, is likewise compressed in response to contacting with the first and the second component—can in each case transfer a spring force to the at least one inner conductor, by means of which spring force the at least one inner conductor in each case exerts a sufficient contact pressure on the first and second component.

The at least one inner conductor is in each case embodied to be metallic in order to realize an electrical connection for a high-frequency signal between a first component and a second component. It is preferably embodied to be solely metallically and is made of a single metal.

In accordance with the present disclosure, a compact high-frequency transmission path between two high-frequency components of a minimized number of individual parts may be created in this way. As a function of the axial offset, which is present in the respective operating case, between the two high-frequency components to be connected, this high-frequency transmission path realizes a safe electrical contacting between the two high-frequency components.

Advantageous embodiments and further developments result from the further subclaims as well as from the description with reference to the figures of the drawings.

It goes without saying that the above-mentioned features and the features, which will be described below, cannot only be used in the respective specified combination, but also in other combinations or alone, without leaving the scope of the present invention.

In a preferred formation, the elastic element with its electrically insulating property is made of an elastomer, for example natural rubber, silicon, rubber, or a TPE (thermoplastic elastomer).

With regard to its function as insulator element, the elastic element is arranged between the at least one inner conductor and the outer conductor of the high-frequency contact device and is thus formed approximately sleeve-shaped. In a central area between two end areas, which are each adjacent to an axial end of the elastic element, the elastic element preferably has a reduced stiffness.

This reduced stiffness of the elastic element in its central area advantageously effects that the largest elastic deformation of the elastic element appears predominantly in this central area and not in the two end areas.

The reduced stiffness in the central area of the elastic element is preferably realized by means of a reduced outer diameter and by means of several slots, which run in the longitudinal axial direction and which are located between the outer and inner surface of the elastic element, which is molded to be hollow. In the case of a compressive force acting in the longitudinal axial direction, the reduced outer diameter of the central area increases through these slots, which run in the longitudinal axial direction, while the axial longitudinal extension of the central area of the elastic element advantageously shortens. The reduced outer diameter in the central area can thereby expand up to the size of the non-reduced outer diameter in the end areas of the elastic element.

An additionally reduced stiffness is attained in that at least one recess is in each case provided within the central area of the sleeve-shaped elastic element on the inner and/or outer surface. This at least one recess leads to an additional reduction of the cross section of the elastic element in the area of the recess. The individual recesses are preferably arranged at the points of the central area, at which a change of the elastic element in the radial direction appears particularly strongly in response to contraction.

Due to the reduced outer diameter, the individual slots, and the individual recesses in the central area of the elastic element, the effective permittivity is reduced in a section of the high-frequency transmission path, in which the central area of the elastic element is located. The characteristic wave impedance in this section of the high-frequency transmission path thus increases. To realize a characteristic wave impedance, which is adapted over the entire longitudinal extension of the high-frequency transmission path, the outer diameter of the at least one inner conductor in the section of the high-frequency transmission path, in which the central area of the elastic element is located, is increased as compared to the sections of the high-frequency transmission path, in which the end areas of the elastic element are located in each case.

In some embodiments of a spring-loaded inner-conductor contact element in accordance with the present disclosure, the axial variability of the at least one inner conductor is realized in that the at least one inner conductor in each case consists of a massive first inner-conductor part, which is connected to or can be contacted with the first component, and a massive second inner-conductor part, which is connected to or can be contacted with the second component.

The first and the second inner-conductor part of each inner conductor are in each case in an electrical contact with one another. They can be moved toward one another in the axial direction and overlap one another in the axial direction. Depending on the degree of overlap of the first and of the second inner-conductor part, a different axial extension of the respective inner conductor results. By increasing the degree of overlap of the first and of the second inner-conductor part in the case of a compression of the respective inner conductor as a result of a contact pressure of the second component on the second inner-conductor part or of the first component on the first inner-conductor part, respectively, the effective axial extension of the respective inner conductor is reduced as compared to the non-compression case. An inner conductor comprising an extension, which is variable in the axial direction, is thus realized via the axial overlap of the first and of the second inner-conductor part of the respective inner conductor.

The fixation of the elastic element to the at least one inner conductor in each case preferably takes place with the help of at least one claw, which is in each case provided on the inner conductor and which is in each case hooked into an associated recess on the elastic element.

In addition to the spring-loaded inner-conductor contact element, the present disclosure also teaches an assembly that contains the spring-loaded inner-conductor contact element, at least one outer-conductor contact element, the first component, and the second component. Each outer-conductor contact element is in each case arranged adjacent to the spring-loaded inner-conductor contact element. The first component and the second component are thereby connected to one another via the at least one outer-conductor contact element. In addition, the at least one inner conductor of the spring-loaded inner-conductor contact element may be in each case connected to or can be contacted with the first component and with the second component.

Lastly, the present disclosure also teaches an elastic element of an electrically insulating material, which is set up in such a way that it can be fixed to at least one inner conductor of the spring-loaded inner-conductor contact element.

Where it makes sense, embodiments and further developments can be combined in any way. Further possible embodiments, further developments, and implementations of the invention also comprise combinations, which are not mentioned explicitly, of features of the invention, which were mentioned above or which will be mentioned below with regard to the exemplary embodiments. The person of skill in the art will thereby in particular also add individual aspects to the respective basic form of the present invention as improvements or enhancements.

SUMMARY OF THE DRAWING

The present invention will be described in more detail below on the basis of the exemplary embodiments specified in the schematic figures of the drawing, in which.

Unless otherwise specified, elements, features, and components, which are identical, functionally identical, and which act identically, are in each case provided with the same reference numerals in the figures of the drawing.

Figure 1A:
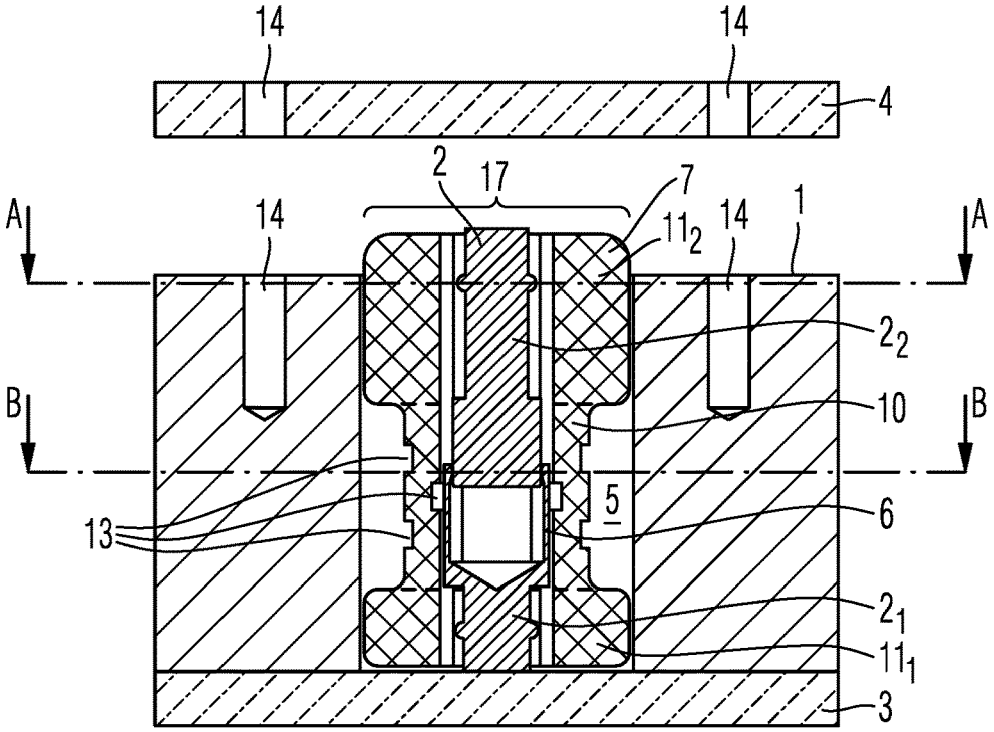
FIG. 1A shows a first cross sectional illustration of an assembly in accordance with the present disclosure comprising a first alternative of the spring-loaded inner-conductor contact element in the non-contacted state.

The figures will be described coherently and comprehensively below.

DESCRIPTION OF EXEMPLARY EMBODIMENTS

Before an assembly in accordance with the present disclosure comprising a second alternative of a spring-loaded inner-conductor contact element for transmitting a differential high-frequency signal, i.e. a symmetrical high-frequency signal, between two high-frequency components will be described on the basis of FIGS. 2A to 2C, an assembly in accordance with the present disclosure comprising a first alternative of a spring-loaded inner-conductor contact element for transmitting an asymmetrical high-frequency signal will be introduced in detail on the basis of FIGS. 1A to 1F, which now follow:

In the case of a transmission of an asymmetrical high-frequency signal, the high-frequency transmission path is embodied as coaxial transmission path. For this purpose, the coaxial transmission path preferably has a metallic outer-conductor contact element 1 and a single metallic inner conductor 2, which is arranged coaxially to the outer-conductor contact element 1 within the outer-conductor contact element 1.

In a preferred embodiment, the outer-conductor contact element 1 is thereby realized as electroconductive intermediate component between a first component 3, preferably a first high-frequency component, and a second component 4, preferably a second high-frequency component. This intermediate component corresponds to a housing and, for this purpose, has an interior 5, which is preferably molded cylindrically and which extends between the first component 3 and the second component 4. The intermediate component, which serves as outer-conductor contact element 1, is in an electrical contact with associated outer-conductor contact surfaces on the first component 3 and on the second component 4.

The intermediate component, which serves as outer-conductor contact element 1, is embodied to be rigid and thus has a constant axial extension. In addition, the intermediate component is firmly connected mechanically to the first component 3 and the second component 4. A solder connection and/or a screw connection, for example, can serve as mechanical connection thereby. As can be seen from FIG. 1C, the first component 3 is connected to the intermediate component, which serves as outer-conductor contact element 1, via a solder connection, while the second component 4 is fastened to the intermediate component via a screw connection. For this purpose, bores 14, which are aligned with one another and into which matching screws 15 are screwed in each case, are provided for this purpose in the second component 4 and in the intermediate component. The intermediate component is preferably connected to the first and the second component 3 and 4 without slot-shaped openings.

The inner conductor 2 is located within the interior 5 of the intermediate component, which serves as outer-conductor contact element 1, and is arranged coaxially to the outer-conductor contact element 1 in the interior 5. In the assembled state according to FIG. 1C, it extends between the associated inner-conductor contact surfaces of the first and of the second component 3 and 4.

If several high-frequency transmission paths are present between the first and the second component 3 and 4, several bores, which are separated from one another and in which an inner conductor is in each case arranged coaxially to the intermediate component, which serves as outer-conductor contact element 1, are provided in the intermediate component. The intermediate component thereby serves as common outer conductor 1 for each individual coaxial high-frequency transmission path.

Due to production-related inaccuracies in the planarity of the two surfaces, which are oriented towards one another, of the first and of the second component 3 and 4, as well as of the two front faces of the intermediate component, which serves as outer-conductor contact element 1, the distance between the two inner-conductor contact surfaces of the first and of the second component 3 and 4 is typically variable from assembly to assembly. An axial offset, which is to be compensated by means of an inner conductor 2 comprising an axially variable extension, is thus present on the inner conductor side.

For this purpose, the inner conductor of the inner-conductor contact element 17, which is variable in its axial extension, consists of a massive, first inner-conductor part $\mathbf{2}_1$, and a massive, second inner-conductor part $\mathbf{2}_2$, which are in an electrical contact with one another on the one hand, and which can be moved towards one another in the axial longitudinal extension on the other hand.

The first inner-conductor part $\mathbf{2}_1$ and the second inner-conductor part $\mathbf{2}_2$ are each rigid components, wherein the first inner conductor part $\mathbf{2}_1$ has an elasticity only in the contacting area with the second inner-conductor part $\mathbf{2}_2$. The first inner conductor part $\mathbf{2}_1$ is preferably a component, which, in particular in the contacting area with the second inner-conductor part $\mathbf{2}_2$, has a higher stiffness in the axial direction than in the radial direction.

Figure 1B:
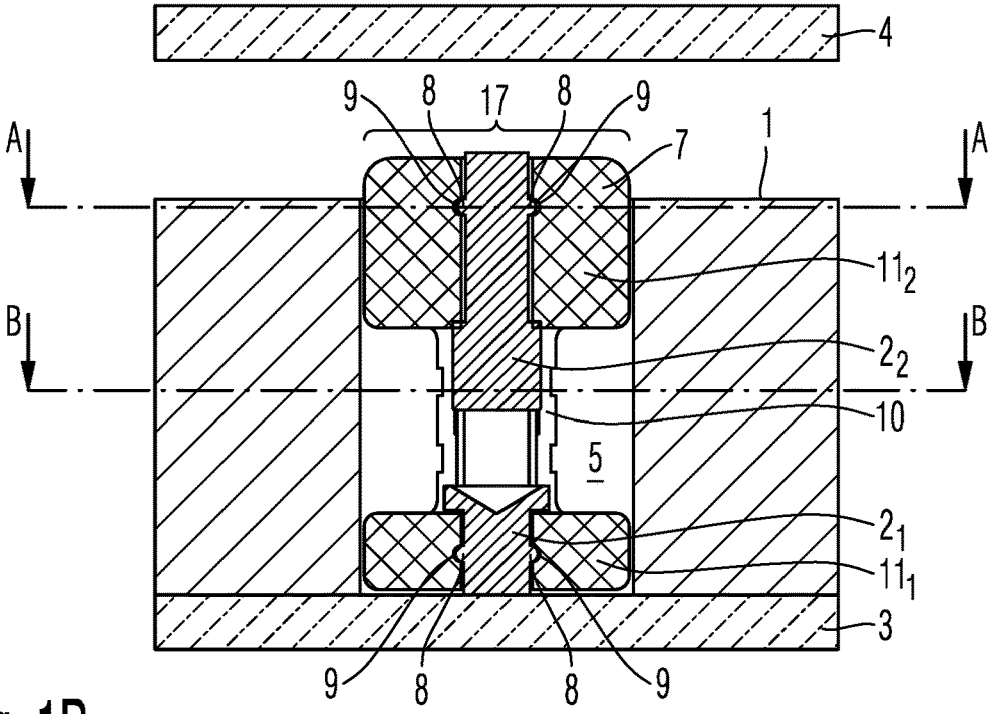
FIG. 1B shows a second cross sectional illustration of an assembly in accordance with the present disclosure comprising a first alternative of the spring-loaded inner-conductor contact element in the non-contacted state.
Figure 1C:
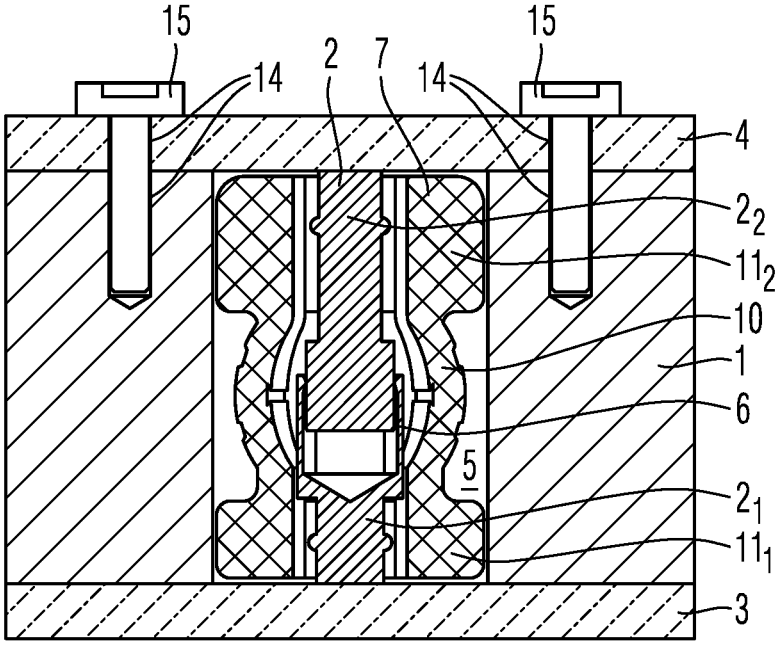
FIG. 1C shows a first cross sectional illustration of an assembly in accordance with the present disclosure comprising a first alternative of the spring-loaded inner-conductor contact element in the contacted state.
Figure 1D:
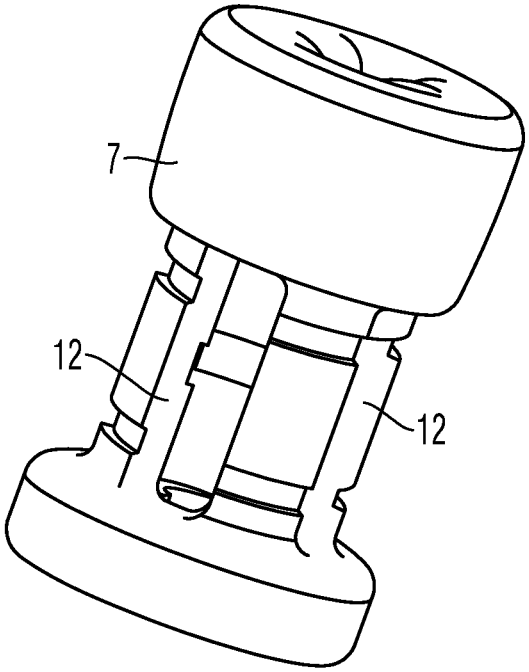
FIG. 1D shows a three-dimensional illustration of an elastic element in accordance with the present disclosure.
Figure 1E:
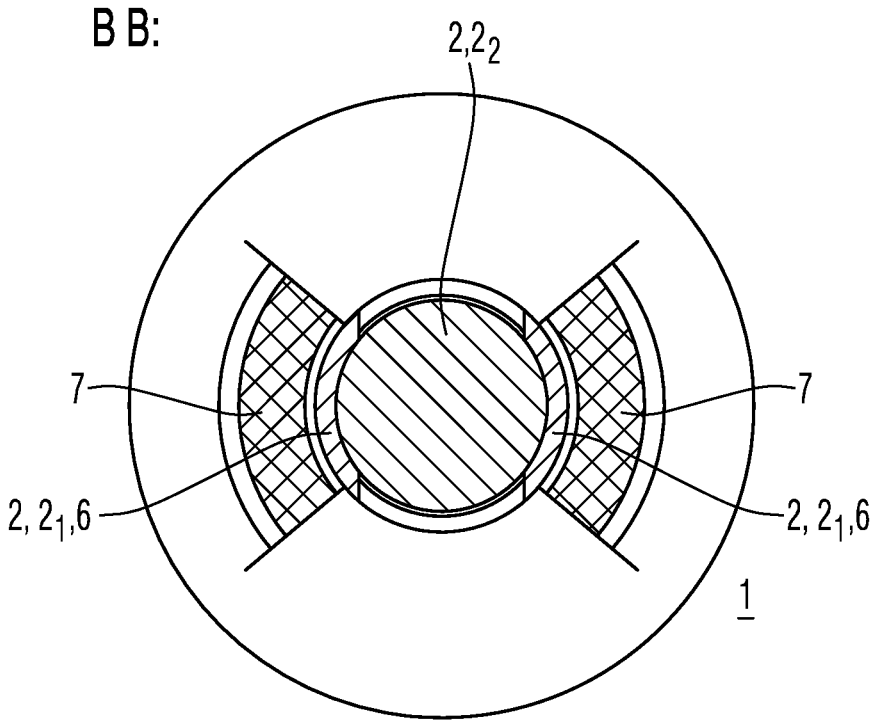
FIG. 1E shows a third cross sectional illustration of an assembly in accordance with the present disclosure comprising a first alternative of the spring-loaded inner-conductor contact element in the non-contacted state.
Figure 1F:
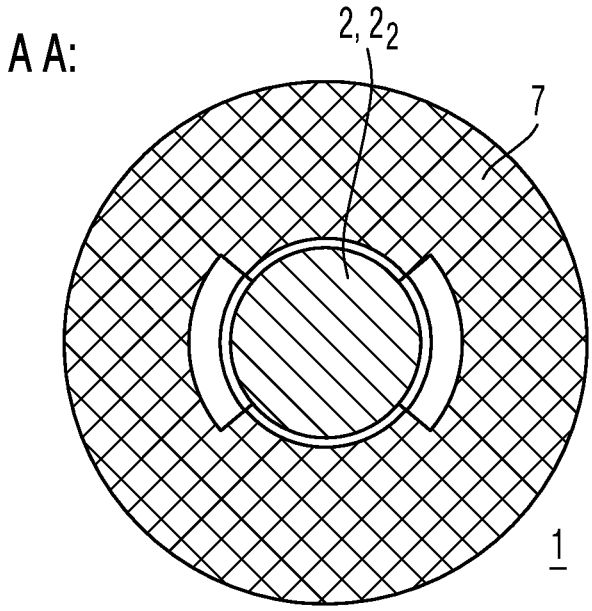
FIG. 1F shows a fourth cross sectional illustration of an assembly in accordance with the present disclosure comprising a first alternative of the spring-loaded inner-conductor contact element in the non-contacted state.

To realize a safe electrical contact between the first and the second inner-conductor part $\mathbf{2}_1$ and $\mathbf{2}_2$, either the first inner-conductor part $\mathbf{2}_1$ or the second inner-conductor part $\mathbf{2}_2$ is in each case molded as spring sleeve in its contact area with the respective contacting inner-conductor part $\mathbf{2}_2$ or $\mathbf{2}_1$, respectively. In FIGS. 1A, 1B, and 1C, for example the first inner-conductor part $\mathbf{2}_1$ is molded in its contact area as spring sleeve, which contacts the inner surface of the second inner-conductor part $\mathbf{2}_2$ with expansions, which are directed radially to the inside, on the distal ends of its spring tabs 6.

The spring sleeve of the first or of the second inner-conductor part can be moved in the longitudinal direction on the inner surface of the second or first inner-conductor part $\mathbf{2}_2$ or $\mathbf{2}_1$, respectively, which is to be electrically contacted, so that an overlap of the first and of the second inner conductor part $\mathbf{2}_1$ and $\mathbf{2}_2$ can be realized over a path of different length as a function of the size of the existing axial offset. The effective axial extension of the inner conductor 2 results from the degree of overlap of the first and of the second inner-conductor part $\mathbf{2}_1$ and $\mathbf{2}_2$.

The first inner-conductor part $\mathbf{2}_1$ of the spring-loaded inner-conductor contact element 17 is firmly connected electrically and mechanically to an associated contact surface on the first component 3. The mechanically firm connection thereby takes place via conventional connecting techniques, for example by means of soldering. In the alternative, the first inner-conductor part $\mathbf{2}_1$ can only be in an electrical contact with the first component 3. In this case, the first inner-conductor part $\mathbf{2}_1$ is pushed onto the associated contact surface on the first component 3 via the contact pressure, which is exerted by the second component 4 on the second inner-conductor part $\mathbf{2}_2$ and which is transmitted from the second inner-conductor part $\mathbf{2}_2$ to the first inner-conductor part $\mathbf{2}_1$.

As an equivalent, the second inner-conductor part $\mathbf{2}_2$ of the spring-loaded inner-conductor contact element 17 is in an electrical contact with an associated contact surface on the second component 4 in the assembled state of the assembly according to FIG. 1C. In the alternative, the second inner-conductor part $\mathbf{2}_2$ of the spring-loaded inner-conductor contact element 17 can be firmly connected mechanically to an associated contact surface on the second component 4.

The first component 3 and the second component 4 are preferably each high-frequency components. The first and the second component 3 and 4 can thus each typically be a printed circuit board, which is equipped with a high-frequency electronics, a housing, in which a high-frequency electronics is installed, a substrate, in which a high-frequency electronics is integrated, or an individual high-frequency component, for example a high-frequency filter or a high-frequency amplifier.

An elastic element 7 of an electrically insulating material is arranged coaxially to the outer-conductor contact element 1 and to the inner conductor 2 within the spring-loaded inner-conductor contact element 17. An elastomer, for example natural rubber, silicon, rubber or a thermoplastic elastomer (TPE) is preferably suitable as electrically insulating material comprising elasticity.

Within the spring-loaded inner-conductor contact element 17, the elastic element 7 is fixed to the inner conductor 2, preferably to the first inner-conductor part $\mathbf{2}_1$ as well as to the second inner-conductor part $\mathbf{2}_2$. As follows clearly in particular from FIG. 1B, claws 8 preferably serve as fixation, which, as compared to FIG. 1A, is rotated by 90° about the longitudinal axis of the high-frequency transmission path. These claws 8, which are each molded on the outer surface of the first and second inner-conductor part $\mathbf{2}_1$ and $\mathbf{2}_2$ and which are hooked into associated recesses 9 at matching positions on the inner surface of the elastic element 7. Alternative fixing methods, such as, for example, adhesion, also belong to the present disclosure. In the alternative, the elastic element 7 can also be fixed only to the second inner-conductor part $\mathbf{2}_2$ within the spring-loaded inner-conductor contact element 17.

Due to the fixation of the elastic element 7 to the inner conductor 2, preferably to the first and to the second inner-conductor part $\mathbf{2}_1$ and $\mathbf{2}_2$, the first inner conductor part $\mathbf{2}_1$ and the second inner-conductor part $\mathbf{2}_2$ are elastically coupled to one another. Due to this elastic coupling, the first and the second inner-conductor part $\mathbf{2}_1$ and $\mathbf{2}_2$ can be moved elastically to one another. A variable axial extension of the inner conductor 2 is thus realized on the one hand, which, in response to the contacting of the first inner-conductor part $\mathbf{2}_1$ with the first component 3 and of the second inner-conductor part $\mathbf{2}_2$ with the second component 4, corresponds to the distance between the first and the second component 3 and 4. On the other hand, the elastic coupling effects a sufficient contact pressure of the first inner-conductor part $\mathbf{2}_1$ on the first component 3 and of the second inner-conductor part $\mathbf{2}_2$ on the second component 4.

In the case of a coaxial high-frequency transmission path, the elastic element 7 of the spring-loaded inner-conductor contact element 17 is molded in an essentially sleeve-shaped manner. A stiffness, which is reduced to the stiffness in the two end areas $\mathbf{11}_1$ and $\mathbf{11}_2$, is present in a central area 10 of the sleeve-shaped elastic element 7, which extends between the two end areas $\mathbf{11}_1$ and $\mathbf{11}_2$ on the axial ends of the elastic element.

For this purpose, the outer diameter in the central area 10 of the elastic element 7 is reduced as compared to the outer diameter in the two end areas $\mathbf{11}_1$ and $\mathbf{11}_2$. In addition, several slots 12, which run in the axial longitudinal direction of the spring-loaded inner-conductor contact element 17, are arranged, preferably in equidistant angular sections, in the central area 10 of the elastic element 7, as follows from the three-dimensional illustration of the elastic element 7 in FIG. 1D. These slots 12 extend from the outer surface to the inner surface of the sleeve-shaped elastic element 7. The number of the slots 12 is to be selected in a suitable manner.

Due to the reduced outer diameter and due to the provided slots 12 in the central area 10, the diameter of the central area 10 of the elastic element 7 widens in response to a contraction of the elastic element 7, while the axial longitudinal extension of the central area 10 of the elastic element 7 shortens. Due to the contraction of the elastic element 7, the axial longitudinal extension and the outer or inner diameter, respectively, typically does not change in the end areas $11_1$ and $11_2$.

A reduction of the stiffness in the central area 10 of the elastic element 7 is attained by means of additional recesses 13 on the inner surface and/or on the outer surface of the central area 10 of the elastic element 7.

The reduced outer diameter of the center area 10 of the elastic element 7, the slots 12, and the additional recesses 13 in the central area 10 of the elastic element 7 enlarge the characteristic wave impedance in the section of the high-frequency transmission path, in which the central area 10 of the elastic element 7 is located, as compared to the characteristic wave impedance in the sections of the high-frequency transmission path, in which the two end areas $11_1$ and $11_2$ of the elastic element 7 are located. To compensate this change of the characteristic wave impedance, the outer diameter of the first and of the second inner-conductor part $2_1$ and $2_2$ is enlarged in the section of the spring-loaded inner-conductor contact element 17, in which the central area 10 of the elastic element 7 is located, in relation to the outer diameter of the first and of the second inner-conductor part $2_1$ and $2_2$ in the sections of the spring-loaded inner-conductor contact element 17, in which the two end areas $12_1$ and $12_2$ of the elastic element 7 are located in each case. The characteristic wave impedance of the high-frequency transmission path is adapted in an advantageous manner over the entire axial longitudinal extension in this way.

As can be seen from FIG. 1C in the assembled state of the assembly, the axial longitudinal extension of the elastic element 7 is slightly reduced on its axial ends as compared to the axial longitudinal extension of the inner conductor 2 and of the outer-conductor contact element 1. This slight reduction of the axial longitudinal extension provides for a safe electrical contacting of the first inner-conductor part $2_1$ and of the outer-conductor contact element 1, in each case with the first component 3 and of the second inner-conductor contact part $2_2$ and of the outer-conductor contact element 1 in each case with the second component 4.

It should be noted at this point that the outer-conductor contacting cannot only be realized by means of a single outer-conductor contact element 1. In addition to a sleeve or a board comprising bore, which in each case surround the spring-loaded inner-conductor contact element 17 as integral housing between the first and the second component 3, 4, an outer-conductor contacting over several outer-conductor contact elements also belong to the present disclosure. The outer-conductor contact elements can be arranged, for example, coaxially to the spring-loaded inner-conductor contact element 17 on a concentric circle or so as to be distributed in a certain grid around the spring-loaded inner-conductor contact element 17.

In a second alternative, the spring-loaded inner-conductor contact element 17' contains several inner conductors. According to FIGS. 2A, 2B, and 2C, for example two inner conductors $2^1$ and $2^2$, which, together, transmit a differential high-frequency signal (so-called Twinax arrangement), are located in the spring-loaded inner-conductor contact element 17'. However, the teachings of the present disclosure are not limited to two inner conductors. In addition, the present disclosure also covers several pairs of two respective inner conductors, which each transmit a differential signal. In the case of a star-quad arrangement of the inner conductors, for example two pairs of two inner conductors each are in each case arranged so as to cross one another.

According to the second alternative, several inner conductors are present in the spring-loaded inner-conductor contact element 17', so that no coaxiality between the metallic inner conductors $2^1$ and $2^2$, the electrically insulating, elastic element 7', and the metallic outer-conductor contact element 1 is present, as follows from the cross section of FIGS. 2B and 2C.

Figure 2A:
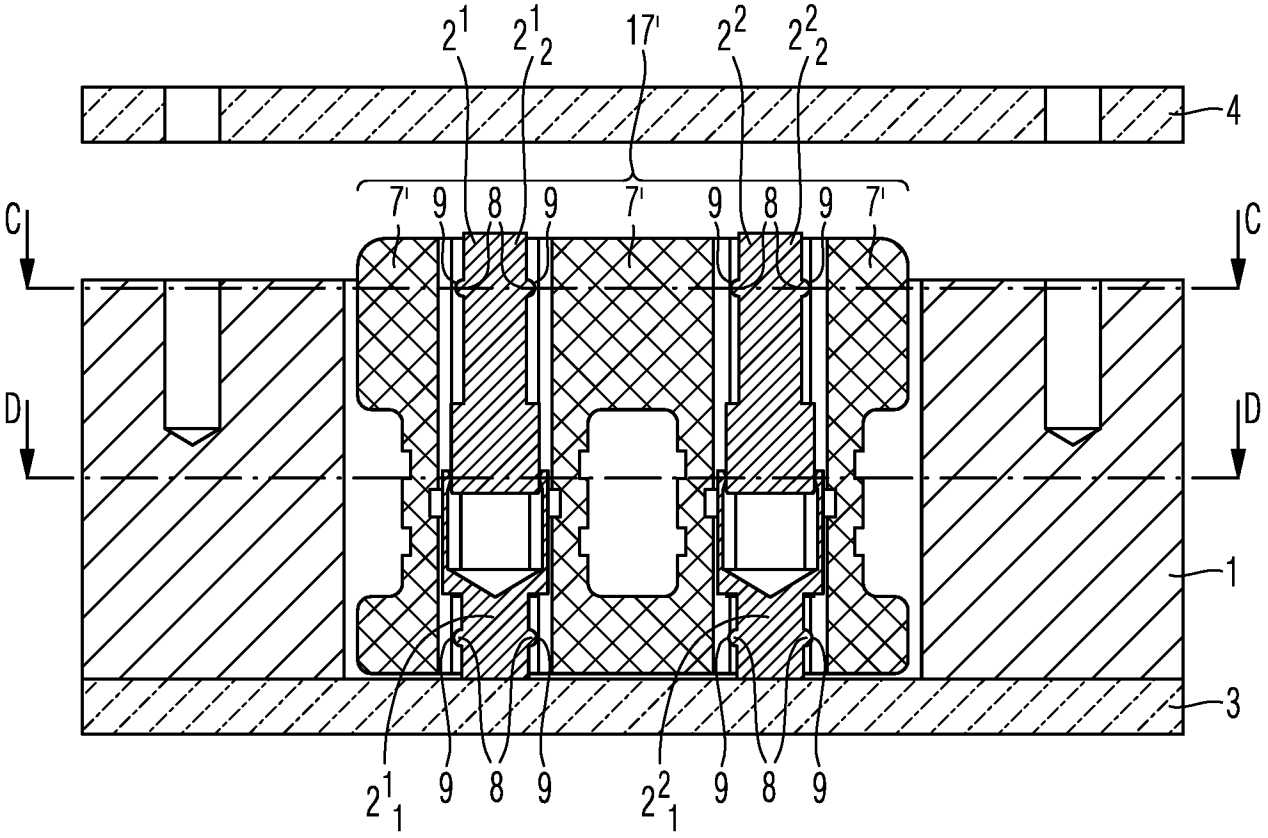
FIG. 2A shows a first cross sectional illustration of an assembly in accordance with the present disclosure comprising a second alternative of the spring-loaded inner-conductor contact element in the non-contacted state.
Figure 2B:
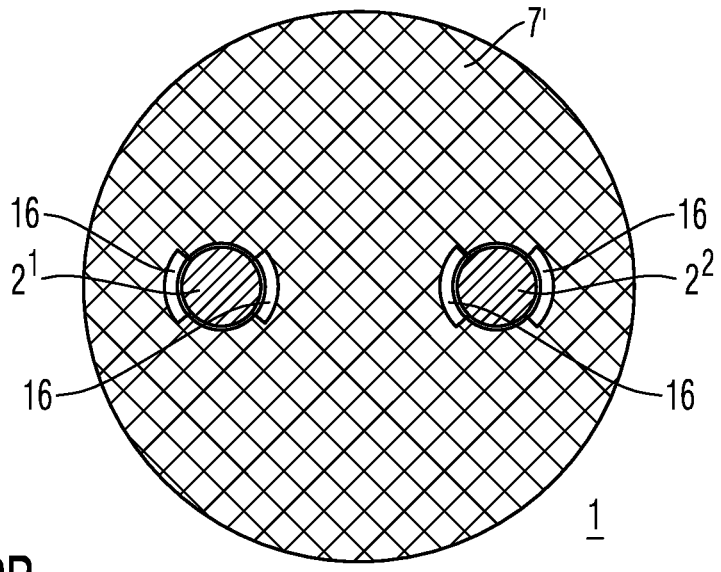
FIG. 2B shows a second cross sectional illustration of an assembly in accordance with the present disclosure comprising a second alternative of the spring-loaded inner-conductor contact element in the non-contacted state.
Figure 2C:
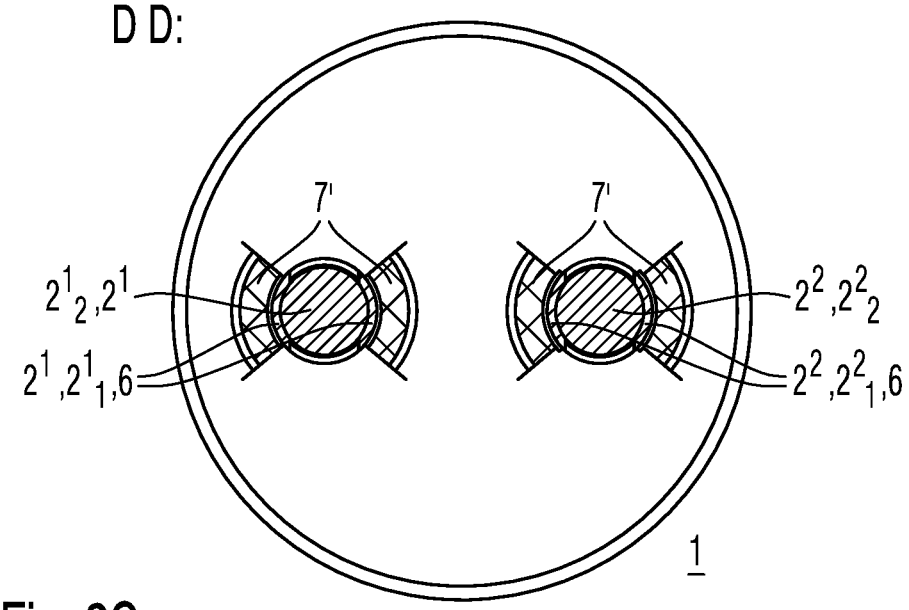
FIG. 2C shows a third cross sectional illustration of an assembly in accordance with the present disclosure comprising a second alternative of the spring-loaded inner-conductor contact element in the non-contacted state, The enclosed figures of the drawing serve to provide a further understanding of the embodiments of the invention. They illustrate embodiments and, in connection with the description, serve to explain principles and concepts of the invention. Other embodiments and many of the mentioned advantages follow with regard to the drawings. The elements of the drawings are not necessarily shown to scale relative to one another.

As can be seen from FIGS. 2A, 2B, and 2C, the inner conductors $2^1$ and $2^2$, which are spaced apart from one another, of the spring-elastic inner-conductor contact element 17', are arranged within the outer-conductor contact element 1 with their massive, first, and second inner-conductor parts $2^1{}_1$ and $2^1{}_2$ or $2^2{}_1$ and $2^2{}_2$, respectively.

To realize a relative elastic movability between the first and the second inner-conductor parts $2^1{}_1$ and $2^1{}_2$ or $2^2{}_1$ and $2^2{}_2$, respectively, of the two inner conductors $2^1$ and $2^2$, an elastic element 7' is fixed between the outer-conductor contact element 1 and the two inner conductors $2^1$ and $2^2$, and on the two inner conductors $2^1$ and $2^2$, preferably by means of claws 8. The fixation of the elastic element 7' to the two inner conductors $2^1$ and $2^2$ preferably takes place, as illustrated in FIG. 2A, on the first inner-conductor parts $2^1{}_1$ and $2^2{}_1$ as well as on the second inner-conductor parts $2^1{}_2$ and $2^2{}_2$. These claws 8, which are provided on the outer surfaces of the inner conductors $2^1$ and $2^2$, are hooked into associated recesses 9 in the elastic element 7'.

To be able to manufacture the elastic element 7' as cast part of an electrically insulating material, preferably of an elastomer, certain areas 16, which are adjacent to the two inner-conductor parts $2^1{}_1$ and $2^2{}_1$, are not filled by the elastic element 7'.

Even though the present invention has been described completely above on the basis of preferred exemplary embodiments, it is not limited thereto, but can be modified in a variety of ways.

LIST OF REFERENCE NUMERALS

1 outer conductor
$1_1$ outer-conductor part
2, $2^1$, $2^2$ inner conductor
$2_1$, $2_2$ first and second inner-conductor part
$2^1{}_1$, $2^1{}_2$, $2^2{}_1$, $2^2{}_2$ first and second inner-conductor part of the differential inner-conductor pair
3 first component
4 second component
5 interior of the intermediate component, which serves as outer conductor
6 spring tab
7, 7" elastic element
8 claw
9 recess
10 central area of the elastic element
$11_1$, $11_2$ end areas of the elastic element
12 slot
13 recess in the central area of the elastic element
14 bore
15 screw
16 area, which is not filled by the elastic element
17, 17" spring-loaded inner-conductor contact element

The invention claimed is:

1. An electrical contact system, comprising:
a metal contact pin; and
an elastic element, wherein
said elastic element extends substantially around an outer circumference of said contact pin,
a length of said contact pin is variable, and
said contact pin mechanically engages said elastic element such that, in response to a variation of said length of said contact pin, a portion of said elastic element moves in sync with a portion of said contact pin in a direction substantially parallel to an overall longitudinal axis of said contact pin.

2. The electrical contact system of claim 1, comprising:

a conductive contact body, wherein said elastic element and said contact pin are situated in a hole in said contact body, and said elastic element insulates said contact pin from said contact body.

3. The electrical contact system of claim 2, wherein:

said contact pin mechanically engages said elastic element such that, in response to said variation of said length of said contact pin, said portion of said elastic element slidingly moves in said hole.

4. The electrical contact system of claim 2, comprising:

a second metal contact pin situated in said hole in said contact body, wherein a length of said second contact pin is variable, and said second contact pin mechanically engages said elastic element such that, in response to a variation of said length of said second contact pin, a portion of said elastic element moves in synch with a portion of said second contact pin in a direction substantially parallel to an overall longitudinal axis of said second contact pin.

5. The electrical contact system of claim 4, wherein:

said second contact pin comprises a first substantially rigid element and a second substantially rigid element in telescoping engagement with said first substantially rigid element.

6. The electrical contact system of claim 1, wherein:

said length of said contact pin is variable in said direction substantially parallel to said overall longitudinal axis of said contact pin.

7. The electrical contact system of claim 1, wherein:

said metal contact pin comprises a first substantially rigid element and a second substantially rigid element in telescoping engagement with said first substantially rigid element.

8. The electrical contact system of claim 7, wherein:

each of said first substantially rigid element and said second substantially rigid element mechanically engages said elastic element, said elastic element thus defining a default length of said contact pin in a non-compressed state.

9. The electrical contact system of claim 1, wherein:

said elastic element comprises a first end portion, a second end portion and an intermediate portion intermediate said first end portion and said second end portion, and said intermediate portion has a stiffness less than a stiffness of each of said first end portion and said second end portion.

10. The electrical contact system of claim 1, wherein:

said intermediate portion comprises a plurality of slits substantially parallel to said overall longitudinal axis of said contact pin.

11. The electrical contact system of claim 1, wherein:

said elastic element comprises a first end portion, a second end portion and an intermediate portion intermediate said first end portion and said second end portion, and said intermediate portion has an outer diameter less than an outer diameter of each of said first end portion and said second end portion.

12. The electrical contact system of claim 11, wherein:

a portion of said contact pin situated in said first end portion has a first diameter and a portion of said contact pin situated in said intermediate portion has a second diameter that is larger than said first diameter.

13. The electrical contact system of claim 1, wherein:

said contact pin comprises a claw that engages a recess in said elastic element.

14. An assembly, comprising: a first component having a first substantially planar surface and a first contact provided on said first substantially planar surface; a second component having a second substantially planar surface and a second contact provided on said second substantially planar surface; a first metal contact pin that electrically connects said first contact and said second contact; and an elastic element, wherein said elastic element extends substantially around an outer circumference of said contact pin, a length of said contact pin is variable, and said first metal contact pin comprises a first metal element and a second metal element in telescoping engagement with said first metal elemont, each of said first metal element and said second metal element mechanically engages said elastic element, said elastic element thus defining a default length of said first metal contact pin in a non-compressed state.

15. The assembly of claim 14, comprising:

a conductive contact body, wherein said elastic element and said first metal contact pin are situated in a hole in said contact body, and said elastic element insulates said first metal contact pin from said contact body.

16. The assembly of claim 15, wherein:

said first metal contact pin mechanically engages said elastic element such that, in response to a variation of said length of said first metal contact pin, said portion of said elastic element slidingly moves in said hole.

17. The assembly of claim 15, comprising: a second metal contact pin situated in said hole in said contact body, wherein a length of said second metal contact pin is variable, and said first component comprises a third contact provided on said first substantially planar surface; said second component comprises a fourth contact provided on said second substantially planar surface: said second metal contact pin electrically connects said third contact and said fourth contact; and said second metal contact pin comprises a first metal element and a second metal element in telescoping engagement with said first metal element, each of said first metal element of said second metal contact pin and said second metal element of said second metal contact pin mechanically engages said elastic element, said elastic element thus defining a default length of said second metal contact pin in a non-compressed state.

18. The assembly of claim 17, comprising:

said third contact is electrically insulated from said first contact, and said fourth contact is electrically insulated from said second contact.

19. An electrical contact system, comprising:

a main body having a first substantially planar surface and a second substantially planar surface;

a first contact that extends at least from said first substantially planar surface to said second substantially planar surface;

a second contact situated in an opening in said first contact; and an elastomeric spring that electrically insulates said second contact from said first contact, wherein said second contact comprises a first end portion that, in an uncompressed state of said second contact, protrudes from said first substantially planar surface, said second contact comprises a second end portion that, in an uncompressed state of said second contact, extends at least to a plane defined by said second substantially planar surface, said first end portion is electrically connected and movable relative to said second end portion, an outer circumference of said first end portion is mechanically engaged with said elastomeric spring, an outer circumference of said second end portion is mechanically engaged with said elastomeric spring, and said elastomeric spring, in response to a release of a compressive force on said second contact, restores said first end portion to a default position relative to said second end portion.

20. The electrical contact system of claim 19, wherein:

said first end portion is non-destructively disengageable from said second end portion.

* * * * *